United States Patent [19]

MeLampy

[11] 4,431,466

[45] Feb. 14, 1984

[54] METHOD FOR MAKING ARMOR PLATE

[76] Inventor: Donald F. MeLampy, Box 331 - R.D. 7, Gibsonia, Pa. 15044

[21] Appl. No.: 244,004

[22] Filed: Mar. 16, 1981

[51] Int. Cl.[3] ..... C21D 1/78

[52] U.S. Cl. ..... 148/143; 148/39; 148/155; 148/157

[58] Field of Search ..... 148/143, 144, 145, 153, 148/155, 157, 134, 39

[56] References Cited

U.S. PATENT DOCUMENTS

| | | | |
|---|---|---|---|
| 941,477 | 12/1909 | Wales | 148/152 |
| 996,544 | 6/1911 | Wales | 148/145 |
| 996,558 | 1/1911 | Bowman | 148/148 |
| 1,987,841 | 1/1935 | Rittershausen | 148/31 |
| 2,254,307 | 9/1941 | Mott | 148/151 |
| 2,857,301 | 10/1958 | Mauzy | 148/18 |

FOREIGN PATENT DOCUMENTS

| | | |
|---|---|---|
| 620117 | 3/1949 | United Kingdom . |
| 666827 | 2/1952 | United Kingdom . |
| 895904 | 5/1962 | United Kingdom . |
| 988047 | 3/1965 | United Kingdom . |
| 1089705 | 11/1967 | United Kingdom . |
| 1188509 | 4/1970 | United Kingdom . |

*Primary Examiner*—R. Dean

*Attorney, Agent, or Firm*—Buell, Blenko, Ziesenheim & Beck

[57] ABSTRACT

A method for making armor plate which comprises commencing with a homogeneous metal plate that has been hardened. Then moving the plate into a liquid bath while applying heat to one surface of the plate. The plate is progressively moved into the bath at an angle while the heat is applied at or near the point of intersection of the plate with the bath and on a surface of the plate which is opposite that which is in contact with the bath.

8 Claims, 1 Drawing Figure

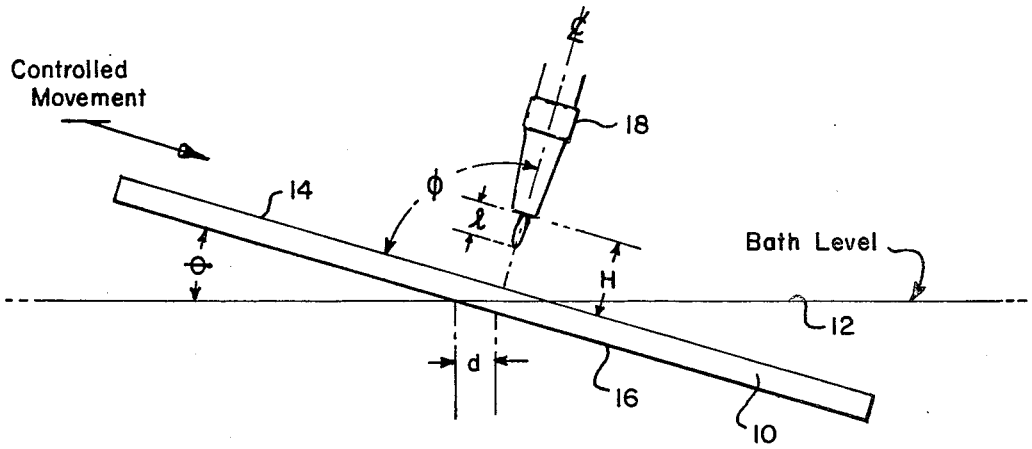
Controlled
Movement
14
18
Bath Level
12
16
10
d
H

METHOD FOR MAKING ARMOR PLATE

PROBLEM PRESENTED TO THE INVENTOR AND PRIOR ART

Armor plate must be very hard to be effective in resisting impacts by projectiles. However, if the plate is too hard the projectile, such as a bullet, will hit the plate and shatter the hard surface and the entire plate.

One approach considered in using homogeneous material has been to compromise the high level and low level of hardness to arrive at a medium hardness to prevent shattering. This single hardness, however, requires that thicker material be used to achieve ballistic resistance. Another approach has been to use a non-homogeneous material which consists of two roll sheets bonded together forming a laminate of similar but different hardenability materials. By heat treating the bonded laminate the product will result in one side with high hardness and the other side with a relative lower hardness. The softer side of relatively lower hardness will support the hard side and prevent the entire plate from shattering, this product displays a higher ballistic resistance for a given thickness when compared to the above mentioned homogeneous armor.

This would result in a desired characteristic. The problem with using this bonded laminate material is that while the desired characteristics are produced there are economic disadvantages caused by the added costs due to the additional processes involved to produce a good quality joint. Further, the non-homogeneous composite material is prone to distortions during a quenching process.

The third approach is to harden one side only by current methods, all of which require raising only a portion of the material to above the austenitic temperature and quenching leaving a transition area between the hardened material, and the body of the material.

INVENTOR'S SOLUTION TO THE PROBLEM

The inventor has presented a technique for avoiding the need of the composite laminated material while achieving the desirable characteristics of having one side hard and the other side relatively ductile or soft. This is achieved by starting with a homogeneous hardened or hardened and tempered material. One side is rapidly heated to a tempering temperature while the other side has heat drawn from it as rapidly as possible. The side from which the heat is drawn is also shielded from the heating source. This causes the heated side to be tempered (or further tempered if it has previously been heated and tempered), thereby providing a softer yet tougher side while the opposite side retains its hard characteristics.

This method employs a technique to progressively advance the plate at an angle towards a bath of water, water base solutions, gas, cool air or combinations of these and heat a top side to a tempering temperature while simultaneously submerging an opposite bottom side in the bath to prevent that side from increasing its temperature and avoid any reduction in the hardness of the bottom side. Further, as the top side advances into the bath it is cooled. The result will produce a differential of hardness between the top side and the bottom side. The top side will be tempered or tempered at a higher temperature and will have softer, tougher characteristics than the bottom side which has maintained its original hardness.

DESCRIPTION OF THE FIGURE

The FIGURE shows an embodiment of the method for progressively advancing a plate into a bath while heating one side.

DESCRIPTION OF ONE EMBODIMENT OF THE METHOD

The FIGURE shows a metal plate 10 which is progressively advanced into a water bath 12. The plate 10 has a top side surface 14 and bottom side surface 16. The plate is advanced into the bath 12 at an angle $\theta$ which is less than 90% and preferably in the range of 5° and 30° between the bottom surface 16 and the top of the bath 12. An acetylene torch 18 applies heat to the top surface 14 at or adjacent to the intersection of the plate 10 with the water bath 12.

Seven pre-hardened and tempered samples were tested. 28 PSI of oxygen and 14 PSI of acetylene were used for each plate which was advanced at the rate of 18.5 inches per minute thru 23.5 inches per minute. The displacement d, namely the point of impingement of heat with respect to the intersection of the plate with the bath was zero. The distance H from the torch tip to the top surface 14 was ⅜".

Tests were made starting with a steel plate ¼" thick with thermocouples imbedded at various depths and readings indicated that while the maximum temperature of the surface exposed to the heat source reached 865° F., the opposite side surface only reached 421° F., maximum.

| Sample No. | Brinell Hardness Before Heating | Material Thickness | Material Composition | Brinell Hardness After Heating Top Surface | Brinell Hardness After Heating Bottom Surface | Flame Length (Cone) |
|---|---|---|---|---|---|---|
| 1 | 514 | ¼ | 4340 | 415 | 514 | ¼" |
| 2 | 477 | ¼ | 4340 | 388 | 477 | ⅜" |
| 3 | 418 | ¼ | XAR-30 | 321 | 418 | ¼" |
| 4 | 418 | ¼ | XAR-30 | 302 | 418 | ⅜" |
| 5 | 444 | ¼ | 4340 | 388 | 444 | ¼" |
| 6 | 512 | 0.3 | 4350 M | 401 | 601 | ⅜" |
| 7 | 477 | | 4340 | 402 | 477 | ⅜" |

Sample number 2 had a projectile fired against it and repelled military ball type ammunition at point blank muzzle velocities although armor piercing slugs did penetrate the plate. It is believed that higher face hardness will be able to withstand the armor piercing ammunition.

Sample 6 was tested for military ballistic characteristics according to military specifications that determines the velocity at which penetration occurs and the velocity at which it is capable of repelling the projectile. This test permits rating the sample relative to established standards that specify various velocities for various thicknesses. This sample was able to withstand 30% higher velocities than standard homogeneous armor as specified. This test was done with standardized armor piercing projectiles fired at various velocities and recorded by electronic timing devices. It is believed that non-homogeneous metal plates could have their characteristics improved also.

I claim:

1. A method for making armor plate comprising:

(a) providing a metal plate which has been hardened and tempered throughout and having a top side and a bottom side;

(b) then heating the top side to further temper the top side; and (c) simultaneously preventing the bottom side from further tempering by moving the plate progressively into a liquid bath at an angle while applying the heat to the top side of the plate approximately adjacent to the intersection of the plate and the bath resulting in a top side having softer, tougher characteristics than the bottom side which has maintained its original hardness.

2. The method as recited in claim 1 wherein the plate is moved into the bath at an angle which is less than 90° between the bottom side and the bath.

3. The method as recited in claim 1 wherein the plate is moved into the bath at an angle in the range of 5° to 30° between the bottom side and the bath.

4. The method as recited in claims 1, 2 or 3 wherein the plate provided is homogeneous.

5. A method for making armor plate comprising:

(a) providing a metal plate which has been hardened throughout and having a top side and a bottom side;

(b) then heating the top side to a tempering temperature; and (c) simultaneously preventing the bottom side from reaching a tempering temperature by moving the plate progressively into a liquid bath at an angle while applying the heat to the top side of the plate approximately adjacent to the intersection of the plate and the bath resulting in a top side which is tempered and a bottom side which is hard.

6. The method as recited in claim 5 wherein the plate is moved into the bath at an angle which is less than 90° between the bottom side and the bath.

7. The method as recited in claim 5 wherein the plate is moved into the bath at an angle in the range of 5° to 30° between the bottom side and the bath.

8. The method as recited in claims 5, 6 or 7 wherein the plate provided is homogeneous.

* * * * *